United States Patent [19]

Gelvin

[11] Patent Number: 4,868,548

[45] Date of Patent: Sep. 19, 1989

[54] CLOCK SYNCHRONIZATION SYSTEM

[75] Inventor: David C. Gelvin, Escondido, Calif.

[73] Assignee: Brooktree Corporation, San Diego, Calif.

[21] Appl. No.: 102,034

[22] Filed: Sep. 29, 1987

[51] Int. Cl.[4] ..... G09G 1/00

[52] U.S. Cl. ..... 340/709; 340/825.210; 340/825.200; 340/706; 340/814

[58] Field of Search ..... 358/22; 344/731; 340/825.2, 825.21, 706, 709, 734, 814

[56] References Cited

U.S. PATENT DOCUMENTS

| | | | |
|---|---|---|---|
| 4,543,427 | 3/1985 | Iids | 340/731 |
| 4,589,429 | 5/1986 | Torimaru et al. | 340/731 |
| 4,757,311 | 7/1988 | Nakamura et al. | 340/731 |

*Primary Examiner*—Donald J. Yusko
*Assistant Examiner*—Eric Oliver Pudpud
*Attorney, Agent, or Firm*—Ellsworth R. Roston; Charles H. Schwartz

[57] ABSTRACT

An apparatus and method of synchronizing data systems having different clock frequencies at a particular address. A first device receives first and second parallel data and outputs first serial data at a first particular clock frequency. A second device outputs second parallel data at a second particular clock frequency that is a submultiple at an integer "n" of the first particular clock frequency. The second parallel data is outputted in groups of "n" pieces of data. The address is combined with the integer "n" until the combination passes through a particular numerical value. This produces a first signal representative of the combination passing through the particular numerical value and a second signal representing an offset position less than "n" relative to the first serial data. The first and second signals control second parallel data to initiate the outputting of the second parallel data in accordance with the first signal and to offset the outputted second parallel data in accordance with the second signal. The offset second parallel data may then be merged with the first serial data beginning at the proper address.

24 Claims, 4 Drawing Sheets

CLOCK SYNCHRONIZATION SYSTEM

BACKGROUND OF THE INVENTION

1. Field of the Invention

The present invention relates to an apparatus and method for synchronizing systems having different clock frequencies. Specifically, the invention relates to a synchronization system for use as part of a cursor control so as to properly present intensity data of a cursor pattern for display in correct synchronization with video data which is normally presented to a high resolution display.

2. DESCRIPTION OF THE PRIOR ART

High resolution graphic displays typically used as part of a computer system normally include a cursor which can be visually shifted to any portion of the display screen either manually or automatically. The cursor display may take a variety of patterns and a typical cursor is formed as a small arrow. The cursor pattern is provided as an overlay to the normal video data which is presented on the display screen. The location of the cursor should appear at any randomly selectable coordinate position on the display screen and the presentation of the cursor overlay pattern should be synchronized with the normal video data.

In the prior art, cursor overlay patterns have been presented directly to the video display as a separate input and not forming part of the normal video input. This type of prior art cursor display is relatively expensive since it requires completely separate hardware including the generation of clock signals in synchronism with the normal video input. This type of prior art system being separate from the generation of the video signals cannot utilize the flexibility and the advantages of new types of video display systems. An alternative way of providing cursor data is to modify the video memory to include the cursor. This degrades the performance of updating the video while there is cursor movement.

One new type of video display system incorporates a very flexible color generating system referred to as a RAMDAC TM which is a trademark of the assignee of the present application. This "RAMDAC" may be provided on a single IC chip and incorporates a random access memory and integral digital-to-analog converters to provide a complete color palette for the video display. This allows video input signals to be completely adjusted as to color internally within the "RAMDAC" so as to produce output video color signals of any hue or intensity completely under the control of the user of the device. Internally, the "RAMDAC" operates at a high clock speed such as 100–150 MHz. The output from the "RAMDAC" is provided at this high speed on a video coaxial line so as to be a direct input to the video display.

It is, therefore, desirable to produce an overlay signal forming cursor data directly to the "RAMDAC" through an overlay input, with this cursor data in synchronism with the video data. Since the overlay signal forming the cursor data presented to the "RAMDAC" is not at video frequency but is generally at some frequency considerably less than video frequency, such as ¼ or 1/5 of the video frequency, the problem is to synchronize the cursor signal with the regular video signal. Typically, the data inputted to the "RAMDAC" which may be either the regular video data or the cursor data is provided in digital form as groups or blocks of data in parallel Normally, this parallel data is presented at a lower frequency or clock rate, such as ¼ or 1/5 of the frequency of the internal clock of the "RAMDAC". Since blocks of the data are presented in parallel at the lower clock rate, this has the effect, however, of providing the data at a higher serial clock rate since, for example, five pieces of data presented in parallel at 20 or 25 MHz is equivalent to the same five pieces of data transmitted during the same time interval at 100 or 125 MHz in series.

The key problem, however, is that the synchronization of the data between different IC chips can only have clock signals at a relatively low frequency such as 20–25 MHz, but it is desirable to have the internal video clock and the output video signals of the RAMDAC operating at a much higher frequency such as 100 or 125 MHz. Using 25 MHz as an example and with a parallel block of five discrete words of data, it would be desirable to have the video clock operate at 125 MHz which represents a division of five between the two clock signals. If the video clock is 100 MHz and with a parallel block of four discrete words of data, this would represent a division of four between the two video signals. It would, therefore, be desirable to provide an apparatus and method that would allow for the synchronization of data between IC chip systems at frequencies that are a selectable submultiple of the higher clock frequency internal to one of the systems. As an example, it would be desirable to select submultiples such as 5 or 4 or actually any submultiple.

SUMMARY OF THE INVENTION

The present invention will be described with reference to a cursor control system wherein cursor information formed as binary data from a random access static memory (cursor RAM) is shifted to an output buffer in synchronism with an external clock. The external clock is supplied by another device such as a "RAMDAC" which receives the cursor data from the output buffer. The external clock is actually produced from the "RAMDAC" and is at a frequency which is a submultiple of the frequency of a data or pixel clock which is internal to the "RAMDAC". The invention, however, may be used to synchronize data in general between systems wherein the clock frequency of one system is a selectable submultiple of the clock frequency of the other system.

In the description of the present invention, the cursor RAM contains bits which are either 1's or 0's that represent the pixel intensity either full "on" or "off" of a cursor overlay pattern. The location of the cursor must appear on the video display at a randomly selectable coordinate or address on the image produced on the video display by the output signals from the "RAMDAC". The "RAMDAC" includes an overlay input to receive the information to produce the proper cursor display including the information regarding the visual image of the cursor display and with this information occurring at the appropriate time in accordance with the cursor coordinates. These coordinates would be the "x" and "y" address for the cursor. The major problem solved by the present invention is in regard to the presentation of the pixel data representing the cursor to the overlay input of the "RAMDAC" in correct synchronization with the pixel clock which is internal to the "RAMDAC" and is not available directly to the cursor controller. The "y" address is primarily controlled in accordance with the horizontal sync pulse used to initiate the horizontal sweep in the video display so that the "y" address can be controlled directly by counting horizontal sync pulses and without reference to the pixel clock which is internal to the "RAMDAC".

In order to provide for the correct synchronization for the "x" address, an external clock is produced from the "RAMDAC" internal clock, which external clock is a submultiple of the internal clock. The present invention provides a novel method to first select a specific one of the external clock pulses to produce a first signal to control the extraction of the data from the cursor memory. Second, the method of the present invention provides a second signal to control the loading of the data in the correct position in an output buffer which output buffer is then used to supply the information to the overlay input of the "RAMDAC". The invention thereby provides for the first selection to control the location of the cursor on the video display to occur within a given group of five pixels. The second control is of the data position in the output buffer so as to select one pixel of the five in which the cursor pattern begins. In this way, the proper "x" address is synchronized with the internal clock to the "RAMDAC" to produce the data on the visual display representing the cursor at the proper address.

In actuality, the present invention provides for the synchronization of data between systems that are a selectable submultiple of the pixel clock frequency. The particular embodiment of the invention has the capability to select any submultiple such as 5, 4 or even down to 1. The present invention thereby allows great flexibility in providing for the synchronization of data between systems having different clock frequencies.

The present, invention includes the use of a down counter or substractor which receives as one input the "x" address which represents the number of RAMDAC internal video clock cycles which must occur before the output information is displayed. The down counter also receives the external clock which is a submultiple of the RAMDAC internal video clock and with the down counter preset to count down or subtract by a integer "n" which is the submultiple ratio between the external and internal clocks.

When the down counter or subtractor makes a transition by crossing zero, then an underflow or carry signal is used to provide the first selection as indicated above and with the data from the three least significant bits representing a data position in the output buffer to select which pixel of the submultiple number in which to begin the cursor pattern. These two signals, which are the underflow signal and the signal representing the data from the three least significant bits, may then be used to control the output from a cursor RAM which in turn can thereby control the presentation of the signals from the cursor RAM at the appropriate position for display of the cursor information.

A similar but simpler structure may be used to control the "y" position. Specifically, again a down counter can be used to enable the cursor controller to provide for the proper video display, but this can be directly controlled by counting the horizontal sync pulses without the necessity of providing both the first selection and the second control. A first selection is all that is necessary since the horizontal sync count can be used to directly control which line the cursor information is to begin and with this cursor information then enabled for a particular number of lines in accordance with the number of lines in the cursor information. For example, the cursor information may represent a display of 64×64 pixels and with each line in the "y" direction representing a pixel.

BRIEF DESCRIPTION OF THE DRAWINGS

A clearer understanding of the present invention will be had with reference to the following description and drawings wherein.

DETAILED DESCRIPTION OF THE PREFERRED EMBODIMENT

Figure 1:
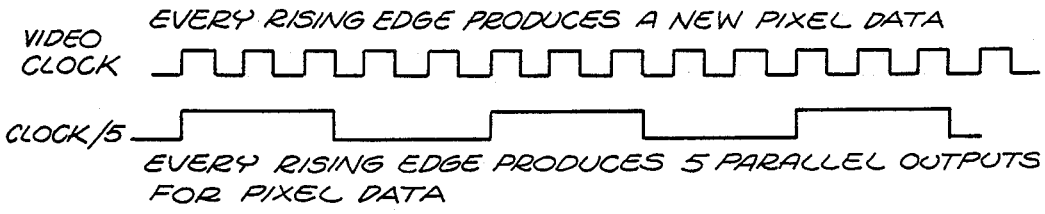
FIG 1. are waveforms illustrating the relationship between the generation of pixel data from an internal video clock and an external clock at a submultiple of the video clock.

As shown in FIG. 1, a video clock may operate at a relatively high speed such as 125 MHz and with each rising edge of the video clock producing a new piece of pixel data. This is the type of information at a video level which is used to produce a high resolution video display. Unfortunately, in order to provide signals between logic chips and to provide these signals at relatively low current levels, the frequencies at which these signals may be supplied between logic chips is considerably lower than the video clock. For example, these lower frequencies may be a submultiple "n" of the video clock such as the video clock divided by five. This is also shown in FIG. 1 by the lower wave form wherein each rising edge portion of the lower frequency submultiple clock represents five parallel outputs for the same pixel data as controlled by the video clock. These multiples could be different. For example, the video clock could be 100 MHz and with a division of four also producing a lower frequency clock of 25 MHz. In any event, it is desirable to have a flexible system wherein the video clock and the external clock are related to each other by some multiple arrangement defined by the integer "n".

Figure 2:
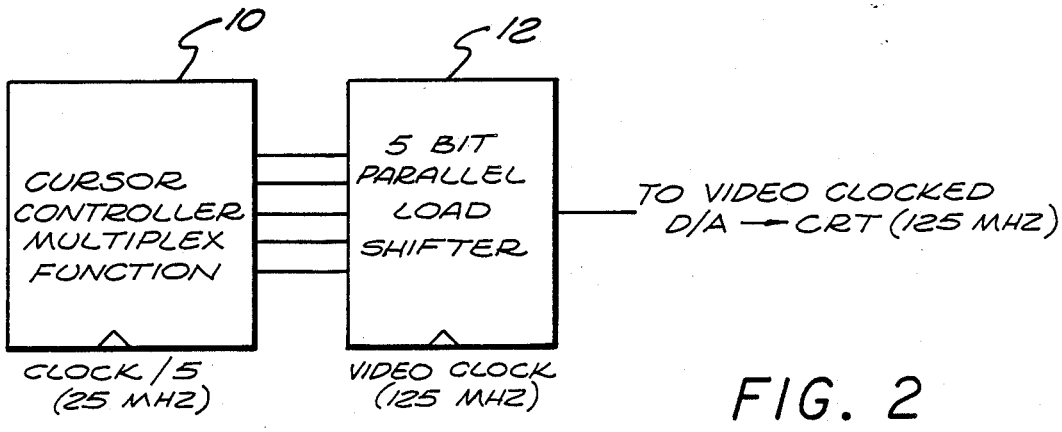
FIG. 2. specifically illustrates how a cursor controller may provide data at one clock rate to a load shifter which can provide output data at a second clock rate.

As shown in FIG. 2 and using the example of a video clock of 125 MHz and a submultiple clock of 25 MHz, basically one logic chip such as a cursor controller 10 may introduce five signals in parallel to parallel load a five bit parallel load shifter. This loading occurs at the clock rate which is the submultiple of the video clock rate. The signals from the parallel load shifter may be shifted out at the video clock rate and may be supplied to a digital-to-analog converter to ultimately be used as input data to a video display such as a CRT.

Figure 3:
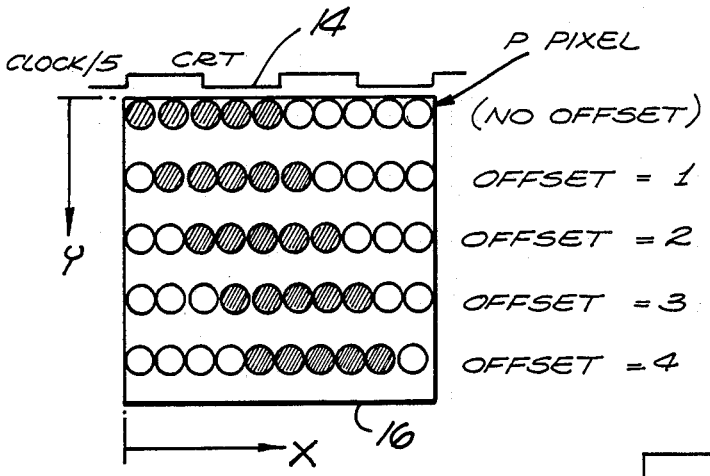
FIG. 3 illustrates providing the data output at a submultiple clock rate and with the output data at the higher clock rate offset so that the video data is controlled at the proper position.

As shown in FIG. 3, one difficulty is that the cursor controller 10 must provide the five outputs in parallel to the parallel shifter 12 but be able to shift them to fall on any pixel boundary. As shown in FIG. 3, the submultiple clock is represented to have five pixels for each rising edge of the submultiple clock. This is shown in waveform 14 which is the same as the lower waveform of FIG. 1. As shown in the block 16 and in the five different lines, the information when presented in serial form may either have no offset or be offset by 1, 2, 3 or 4 pixels. In other words, even though the clock 14 presents five pixels for each clock signal, it is necessary to subdivide the actual pixel information so that the pixel information may be offset so that anyone of the five pixels may be used as the controlling position for the pixel information on the display screen.

To compound the problem as described above, the cursor controller 10 may actually support different clock divisions such as clock divisions other that five. The present invention is capable of any integer "n" clock division and can divide the offset for any number of pixels within any clock submultiple rate wherein the submultiple is a integer between 1 and any integer "n" as long as it can provide an integer clock division of the video clock.

Figure 4:
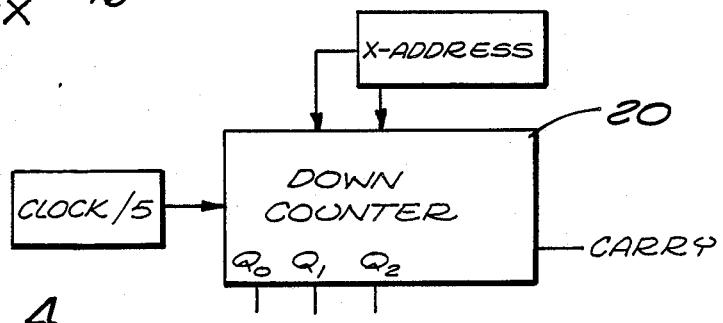
FIG. 4 illustrates in general the use of a down counter to provide for the control of the data in the present invention.

FIG. 4 describes in general a down counter 20 which may be used to provide for appropriate output control signals. The down counter 20 receives "x" address information which represents the number of video clock cycles before the information is to be displayed in the "x" address position. The external clock is also used as an input to control the integer "n" by which the "x" address is counted down. Assuming, for example, that the external clock is the video clock divided by five, then each clock cycle decrements or subtracts in the counter the division ratio of five.

When the counter crosses zero, the down counter 20 produces an underflow or carry signal. This can occur in the following instances for the transfer from time tn to tn +1.

| tn | tn + 1 | |
|---|---|---|
| 0000 → | 1011 | 0 → −5 |
| 0001 → | 1101 | 1 → −4 |
| 0010 → | 1100 | 2 → −3 |
| 0011 → | 1101 | 3 → −2 |
| 0100 → | 1111 | 4 → −1 |

When this carry or underflow signal is produced, then the three least significant digits which are represented by $Q_0$, $Q_1$ and $Q_2$ in FIG. 4 can be decoded to determine which video pixel boundary to begin the output. These techniques will work for any integer clock division. As a specific example, if the video cursor is to begin at the 28 pixel position in the "x" direction, the binary number 28 is set into the "x" address. If as shown in FIG. 4, the clock is divided by five, then every clock/5 signal (external clock signal) reduces the number in the counter by five.

When the counter crosses zero, this produces the underflow or carry signal to indicate that the countdown is complete. The $Q_0$, $Q_1$ and $Q_2$ signals indicate the remainder in the least significant positions which represents the particular pixel or offset that is necessary for the first pixel of the group of five pixels. The system of the present invention operates at the external clock frequency to control the inputing of groups or blocks of data, and provides for the formating of the cursor control data words within the group or block of data to properly position the first word of the cursor pattern.

Figure 5:
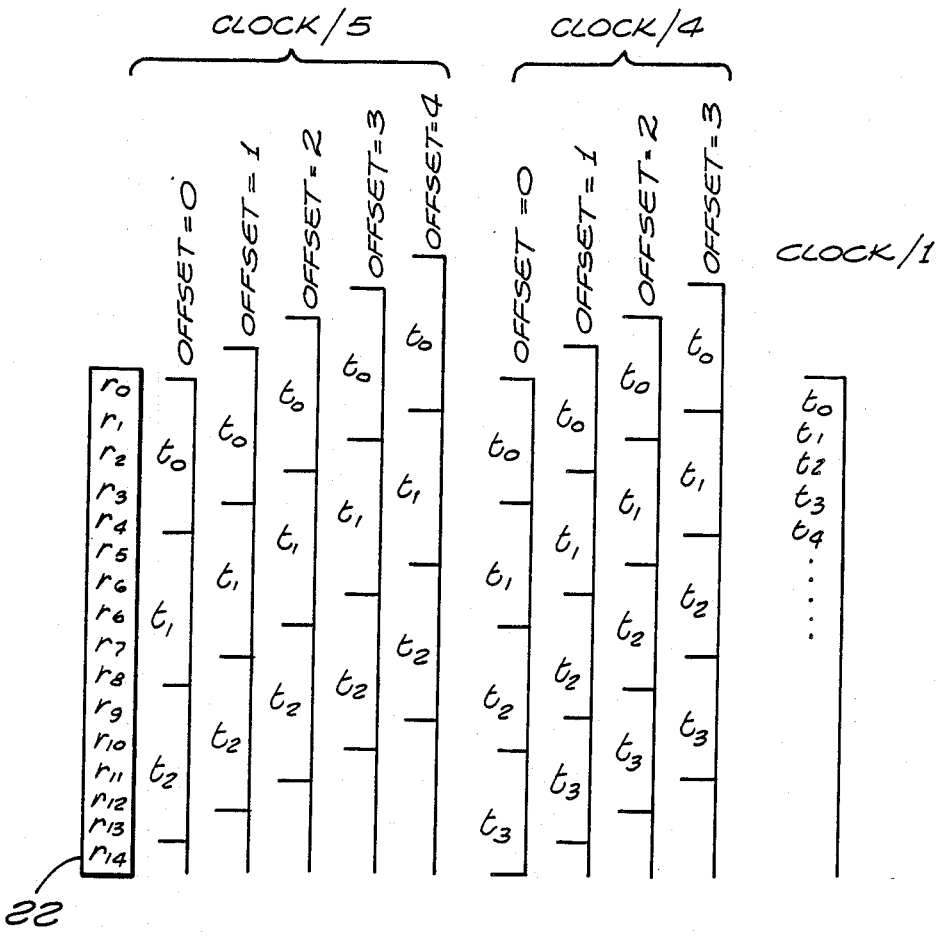
FIG. 5 illustrates the offset for different submultiples of the clock rate.

FIG. 5 illustrates for a number of different submultiples of the video clock how the offset should affect the information in a shift register. Assuming a shift register 22, the offset is shown for a clock divided by five, a clock divided by four or even a clock divided by one. In each time period $t_0$, $t_1$, $t_2$. . . either one, four or five bits may be shifted out from the shift register. The present invention provides for the appropriate offset within the number of bits shifted out for each time $t_0$, $t_1$, $t_2$. . . . In each instance the number of bits shifted out is the same as the division number "n" for the clock so that for a clock divided by five there may be either no offset, one offset, two offsets, three offsets and four offsets as shown in FIG. 5. These are offsets on a pixel by pixel basis so that the information in the shift register may be offset to any one of the pixels in each group. For a division ratio of four, then there may either be no offset, one offset, two offsets or three offsets of the pixels. For a division ratio of one, then there can only be the zero offset which represents the information in the shift register 22.

Figure 6:
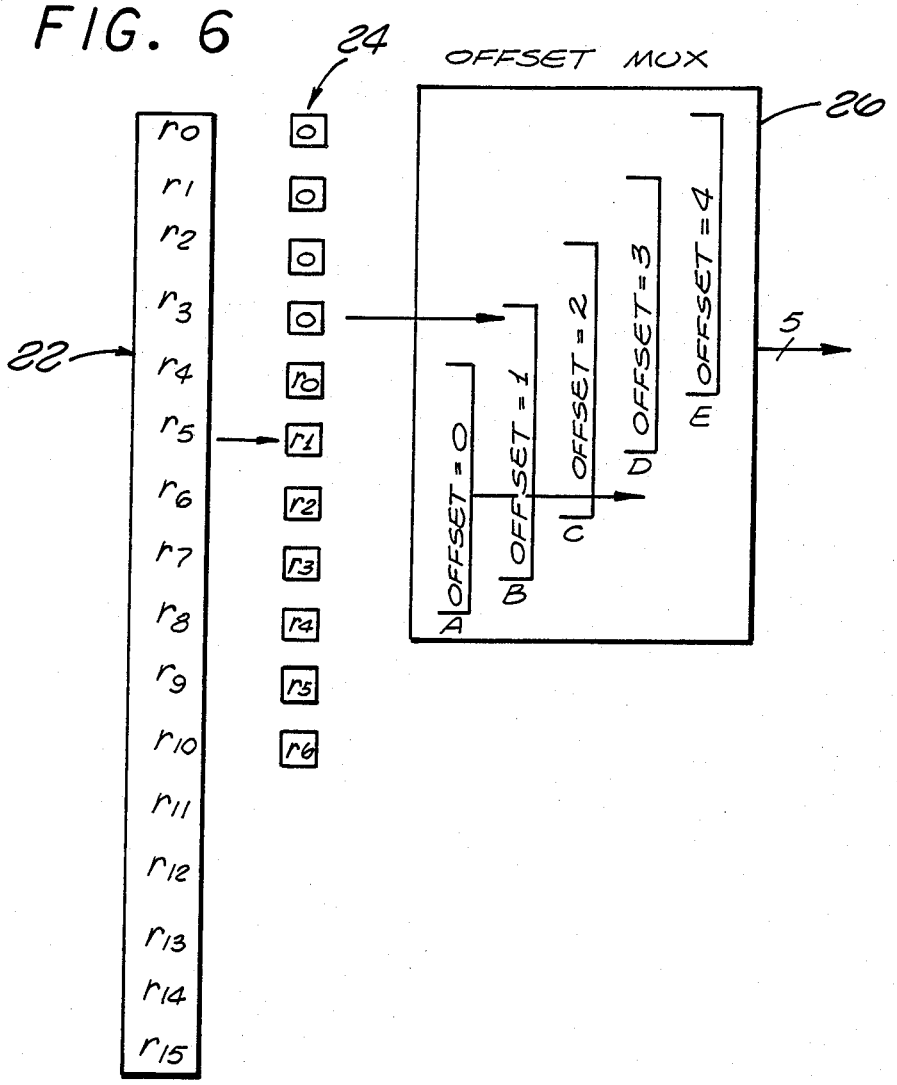
FIG. 6 illustrates the use of a shift register in combination with multiplexers to provide for the proper offset.

In order to provide for the offsets, then the shift register 22 must be reconfigured. This can be accomplished as shown in FIG. 6. As illustrated in FIG. 6, the shift register 22 must essentially be reconfigured as shown at position 24 where, as an example, the shift register has been offset by four pixel positions. The way in which this is actually accomplished in the present invention is to use a serial shift register, such as shift register 22, but to have the output of the shift register pass through one of a plurality of multiplexers A, B, C, D or E which together form an offset multiplexer 26. One of these multiplexers is activated depending upon the value of the least significant bit $Q_0$, $Q_1$ and $Q_2$ shown in FIG. 4.

For the example shown, each multiplexer may be five pixels long. If the system is in the clock/5 mode, as shown in FIG. 5, then the system uses all of the pixels in the selected one of the multiplexers A to E. If the system is in the clock/4 mode also shown in FIG. 5, then the system uses the first four pixels in the selected one of the multiplexers. By using this multiplexer arrangement 26, the system can clock by any number between 1 and "n" and can select any pixel within each pixel block for the offset. Therefore, the shift register 22 essentially operates as if it has been offset as shown in position 24 in FIG. 6, but the shift register still shifts sequentially. However, upon the occurrence of each clock/5 signal or the appropriate "n" submultiple clock signal, the activated multiplexer selects the proper pixels in the shift register at the proper offset position. This arrangement thereby uses a normal shift register, but converts it to select the proper offset for the pixels in the output signals.

Figure 7:
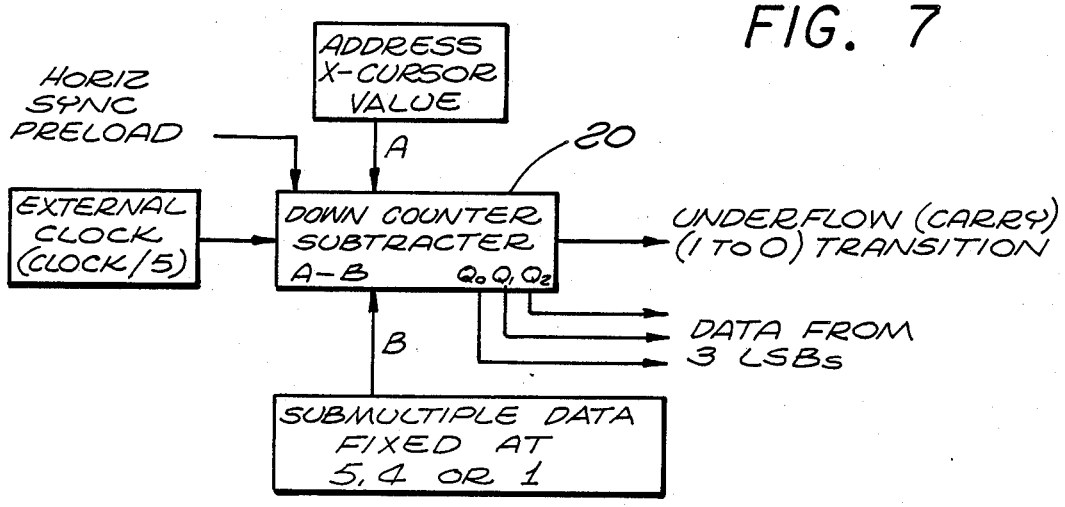
FIG. 7 illustrates in more detail a specific down counter or subtractor used to provide for the proper control signals.

FIG. 7 illustrates in more detail the down counter or subtracter of FIG. 4 as this structure would be used to provide for the control of a cursor signal. The down counter 20 subtracts the value "n" in a B register from the value in an register. The A register is preloaded with the "x" address for the cursor in accordance with a horizontal sync preload signal. The actual "x" address cursor data is generated by a graphics controller in an overall computer system in accordance with the position where the cursor should appear on the video display.

Each time an external clock, which for example may be the video clock divided by five, is presented to the down counter or subtracter 20, the contents of the register B are subtracted from the contents of the register A. The register B is preset to a count of "n" such as five or four or one according to whether the external clock is a submultiple of five or four or one of the video or pixel clock. This submultiple data value applied to the register B would normally be fixed by the manufacturer of the hardware. As described above with reference to FIG. 4, each time the counter or subtracter 20 crosses zero and thereby makes a transition from a one to a zero, the underflow or carry line becomes true. The three least significant bits now provide data to determine which video or pixel boundary to begin the output. This may be seen with specific reference to FIG. 8.

Figure 8:
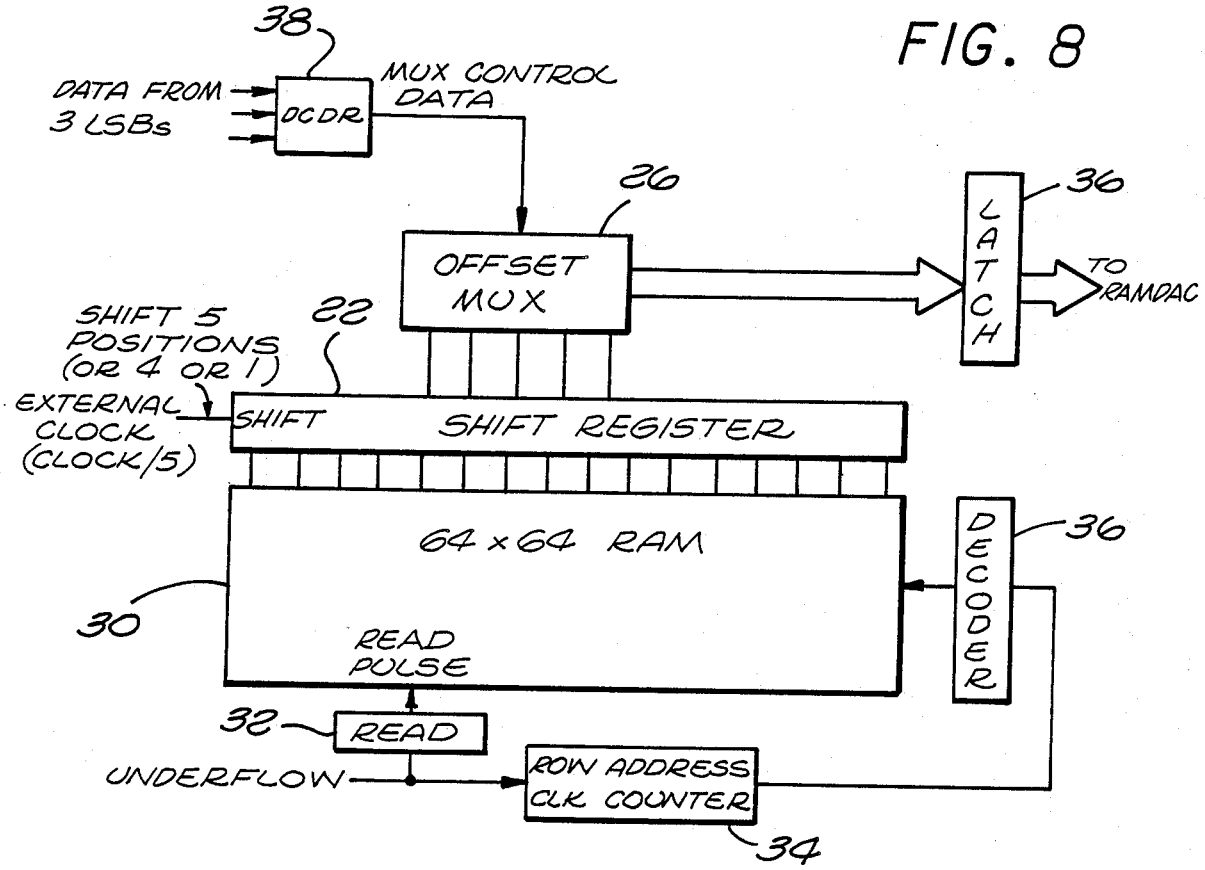
FIG. 8 illustrates a cursor controller for providing for the cursor signals at the appropriate "x" position for the cursor.

As shown in FIG. 8, a 64×64 bit cursor RAM 30 may store pixel data representing a cursor to be superimposed on other video data. The underflow or carry signal initiates the reading of the RAM 30 data in accordance with a read pulse produced by a read input 32. The particular row to be read is determined by a row address counter 34, the output of which is applied to the RAM 30 through a decoder 36. The underflow or carry signal also causes the row address counter 34 to count up by one so that the next row of RAM data will be read upon the arrival of the next underflow signal.

The RAM data is read into the shift register 22 which has been previously described with reference to FIGS. 5 and 6. The shift register also includes as an input the external clock so that the shift register 22 will shift the data for each "n" submultiple for the external clock relative to the video clock. The data is thereby shifted "n" positions along the shift register each time there is an appearance of the external clock signal. Using five as an example, the shift register thereby shifts the information along five positions each time the external clock (clock/5) occurs.

In accordance with the present invention, it is not proper to simply dump the output of the shift register 22 into an output latch 36 since this would not provide for the proper cursor data word offset. This is accomplished by using the offset multiplexer 26 which is described with reference to FIG. 6. The multiplexer 26 determines which of one of the "n" possible cursor data word locations will appear in the first block of data in the output latch 36. The multiplexer control information is derived from the three least significant bits of the down counter (or subtracter) which has been described with reference to FIGS. 4 and 7. Specifically, the information from the three least significant bits is supplied to a decoder 38 and the output of the decoder 38 controls the offset multiplexer to determine which one of the "n" bit multiplexers will be used so as to provide for the appropriate offset in the output signal applied to the "RAMDAC".

Figure 9:
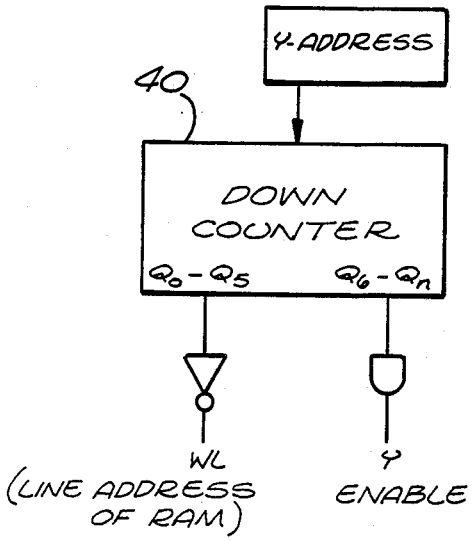
FIG. 9 illustrates a downcounter used to provide for the proper "y" position for the cursor.

FIG. 9 illustrates how the "y" address of the cursor information may be controlled. Specifically as shown in FIG. 9, a down counter 40 may be used to control the "y" position of the cursor information. In general, once the "y" position is found, then the down counter 40 produces signals to allow a particular number of lines to be displayed. In FIG. 8 the 64×64 cursor RAM 30 is used so the down counter 40 will provide that, once the "y" position is found, the next 64 lines must be displayed. The "y" address is also controlled by the horizontal sync. This is because the vertical sync occurs one time for each frame, but the horizontal sync signal is provided for each line of each frame. The "y" address is thereby the number of horizontal syncs after each production of a vertical sync to then reflect the initial line position where the cursor is to be displayed. After the vertical sync is produced, then a particular number of horizontal sync signals represent the vertical position for the cursor.

The cursor must be able to be located either on the video display or actually off the video display. For example, the "y" address, if it is a positive number, may represent the number of lines down from the top of the video screen. If the "y" address is a negative number, it may indicate the number of lines up from the top of the video screen and thereby off the screen. The proper positioning of the cursor in the "y" direction may be provided by producing an enable signal which is produced when the down counter 40 passes from all zeros to all ones. This represents the down counter equaling the "y" address set into the down counter 40. The "y" enable line then enables the cursor for the next 64 lines for the example shown in FIG. 8. This occurs when the six least significant bits all have zeros, as shown by the address Q0–Q5.

Therefore, the down counter 40 operates to provide an enable signal when all of the outputs Q6–Qn pass from zero to one and with the enable signal being terminated for the specific example of 64 lines when the outputs $Q_0$–$Q_5$ all have zeros. The down counter 40 may be incorporated within the cursor controller 10 shown in FIG. 2 and also shown in FIG. 10 so that the cursor information is presented to the "RAMDAC" at the proper "y" position and with the cursor initiated in the "x" direction at the proper position and offset within each group of pixels.

Figure 10:
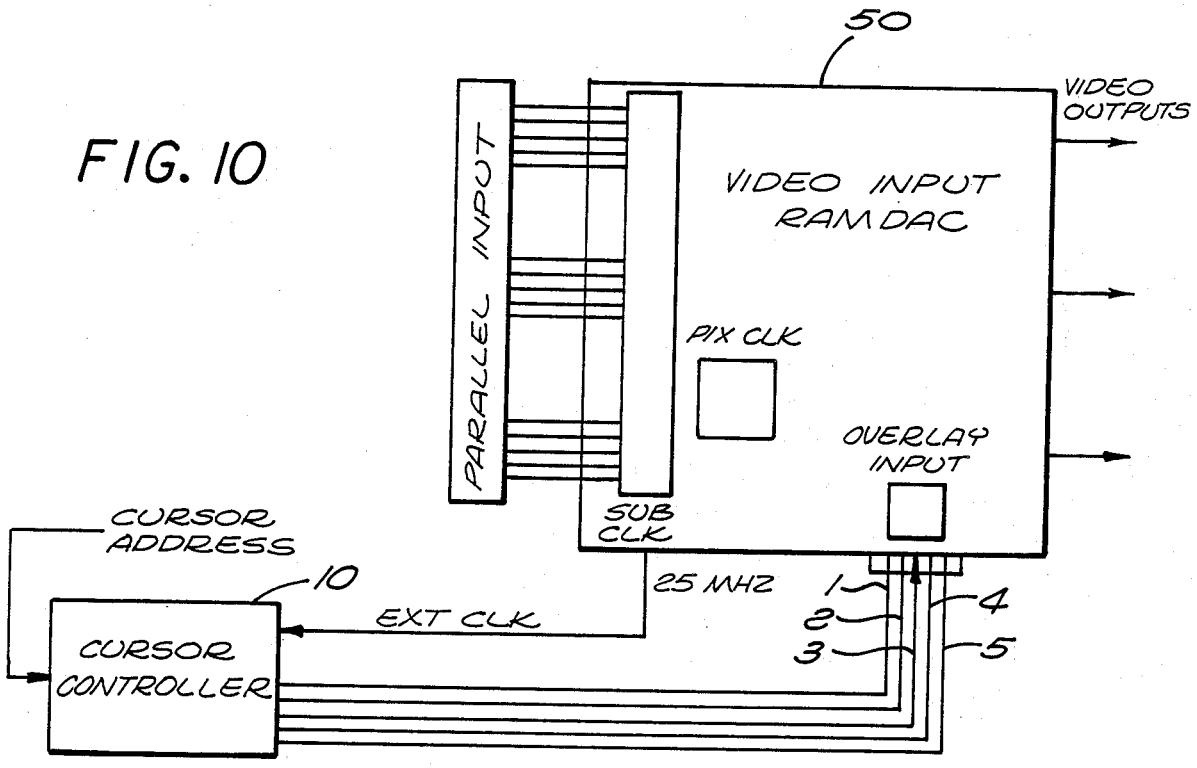
FIG. 10 is a block diagram illustrating the cursor controller of the present invention used in association with a "RAMDAC".

The overall system of the present invention is shown in FIG. 10 and the system includes the cursor controller 10 of the present invention used in combination with a "RAMDAC" 50. As shown in FIG. 10, the "RAMDAC" 50 receives groups of parallel input information and provides for the proper output color information at the video frequency, such as 125 MHz. The "RAMDAC" may include a color palette so that the video information may have the color display under the complete control of the operator of the equipment.

The internal clock rate for the video information is at the high video frequency, such as 125 MHz, but the clock that can be supplied to the cursor from the "RAMDAC" cannot be at such a high frequency and so the appropriate submultiple "n", such as divide by four or five, is chosen to produce the external clock input to the cursor controller 10. In the specific example shown, the external clock is the internal clock divided by five and is 25 MHz. The cursor controller 10 receives as input information the cursor address. This information is used to control the "x" and "y" position including an offset for the "x" position as described above. The output signals, such as five parallel signals at a time, are then provided to an overlay input to the "RAMDAC" 50 to produce an overlay of the cursor information superimposed on the normal video information to thereby merge the two groups of information within the "RAMDAC". Cursor information is provided at the proper offset position on the video display. The clock frequencies of the two systems are in synchronism even though one of the frequencies is a submultiple "n" of the other. The cursor information is controlled to be offset between 0 and "n−1" within this submultiple "n".

Although the invention has been described with reference to a particular embodiment, it is to be appreciated that various adaptations and modifications may be made and the invention is only to be limited by the appended claims.

I claim:

1. Apparatus for synchronizing data between systems having different clock frequencies and with the data synchronized at an address defining a position on a screen in a video display, including first means for receiving first serial data at a first clock frequency, second means for producing first parallel data at a second clock frequency constituting a submultiple of the first clock frequency, the submultiple being defined by the integer "n", the first parallel data being produced in groups of "n", third means responsive to the address and to the integer "n" for successively producing successive numerical values at the address in accordance with the integer "n", fourth means coupled to the third means and responsive to the successive numerical values to produce a first signal when the successive numerical values reach a particular numerical value and to produce, for the first parallel data, a second signal representative of an offset position less than "n" relative to the first serial data, and fifth means coupled to the second and fourth means and responsive to the first parallel data produced in groups of "n" and responsive to the first and second signals for initiating the production of the first parallel data by the second means in accordance with the first signal and for offsetting the produced first parallel data in accordance with the second signal to synchronize the first parallel data with the first serial data at the address.

2. The apparatus of claim 1 wherein the first means includes a digital-to-analog converter and a random access memory and wherein the first parallel data represents color information and wherein the digital-to-analog converter and the random access memory define a color palette to control the color information at individual color positions and wherein the controlled color information is produced as the first serial data at the first clock frequency.

3. The apparatus of claim 2 wherein the second means includes a random access memory for storing information representing a cursor to be overlayed on the color information.

4. The apparatus of claim 1 wherein the third means includes a down counter for successively substracting the integer "n" from the address to produce successively decreasing numerical values and wherein the the fourth means produces the first signal when a particular numerical value becomes zero and the second signal represents the difference between the particular numerical value and zero when the particular numerical value becomes zero.

5. The apparatus of claim 4 wherein the difference between the particular numerical value and zero when the particular numerical value becomes zero defines an integer representing an offset location for the second parallel data to produce synchronism at the address.

6. The apparatus of claim 1 wherein the fifth means includes a shift register responsive to the second parallel data and a plurality of "n" multiplexers and wherein each multiplexer is offset from the other multiplexers by at least one offset position constituting an integral submultiple of "n" and wherein the first signal controls the shift of the second parallel data from the shift register to one of the plurality of multiplexers and wherein the second signal controls the multiplexer which multiplexer receives the second parallel data.

7. A method of synchronizing data between systems having different clock frequencies to provide a display of the data at a particular position on a screen in a video display, including the following steps:

providing a first device for receiving first discrete parallel data and for outputting first discrete serial data at a first particular clock frequency, providing a second device for outputting second discrete parallel data at a second particular clock frequency forming a submultiple at an integer "n" of the first particular clock frequency, the second discrete parallel data being outputted in groups of "n" pieces of discrete data, selecting an address defining the particular position in the video display, successively changing the selected address in accordance with the integer "n" until the selected address reaches a particular numerical value to produce a first signal representative of the selected address reaching the particular numerical value and a second signal representing an offset position from "o" of the second discrete parallel data within the group "n" relative to the first discrete serial data, control the second discrete parallel data in accordance with the first and second signals to initiate the outputting of the second discrete parallel data in accordance with the first signal and to offset the outputted second discrete parallel data in accordance with the second signal, and inputing the initiated offset outputted second discrete parallel data at the second particular clock frequency to the first device to convert the second discrete parallel data to second discrete serial data for merging with the first discrete serial data at the selected address at the first particular clock frequency.

8. The method of claim 7 wherein the first device includes a digital-to-analog converter and a random access memory and wherein the first discrete parallel data represents color information and wherein the digital-to-analog converter and the random access memory form a color palette to control the color information at individual color positions and wherein the controlled color information produced as the first discrete serial data at the first particular clock frequency.

9. The method of claim 8 wherein the second device includes a random access memory for storing information representing a cursor to be overlayed on the color information.

10. The method of claim 7 wherein the step of successively combining includes progressively subtracting the integer "n" from the selected address to produce progressively decreasing numerical values for the selected address and the particular numerical value for the selected address is zero and the second signal represents the offset position just after the particular numerical value becomes zero.

11. The method of claim 10 wherein the particular numerical value defines an integer representing the offset location of the second discrete parallel data from the selected address when the particular numerical value becomes zero.

12. The method of claim 7 wherein the step of controlling the second discrete parallel data includes providing a shift register responsive to the second discrete parallel data and providing a plurality of "n" multiplexers and wherein each multiplexer is offset from the other multiplexers by integral offset positions and wherein the first signal controlling the shift register shifts out the second discrete parallel data from the shift register to the multiplexers and wherein the second signal controls the particular one of the multiplexers which receives the second discrete parallel data.

13. A method of synchronizing data, at a selected address defining a particulate position on a screen in a video display, between systems having different clock frequencies where one of the systems includes a first device for receiving first discrete parallel data and for outputting first discrete serial data at a first particular clock frequency and for receiving second discrete parallel data to be superimposed upon the first discrete parallel data, including the following steps:

providing a second device for outputting the second discrete parallel data at a second particular clock frequency forming a submultiple at an integer "n" of the first particular clock frequency and outputing the second discrete parallel data in groups of "n" pieces of discrete data, successively reducing the selected address in accordance with the integer "n" until the selected address reaches a particular numerical value to produce a first signal representative of the selected address reaching the particular numerical value and a second signal representing an offset position less than "n" and displaced from the position at which the selected address reaches the particular numerical value, controlling the second discrete parallel data in accordance with the first and second signals to initiate the outputing of the second discrete parallel data in accordance with the production of the first signal and the displacement of the outputed second discrete parallel data in accordance with the second signal, and inputing the second discrete parallel data at the second particular clock frequency to the first device to convert the second discrete parallel data to second discrete serial data for merging at the displaced position at the first particular clock frequency with the first discrete serial data.

14. The method of claim 13 wherein the first device includes a digital-to-analog converter and a random access memory and wherein the first discrete parallel data represents color information and wherein the digital-to-analog converter and the random access memory define a color palette to control the color information at individual color positions and wherein the controlled color information is produced as the first serial data at the first clock frequency.

15. The method of claim 14 wherein the second device includes a random access memory for storing information representing a cursor to be superimposed on the color information.

16. The method of claim 13 wherein the step of successively combining includes successively subtracting the integer "n" from the address in accordance with the successive occurrence of the clock signals at the second frequency to produce successively decreasing numerical values and wherein the first signal is produced when the subtracted address reaches the particular numerical value and wherein the second signal represents the difference between the particular numerical value and zero and wherein the second signal is produced when the subtracted address becomes zero.

17. The method of claim 16 wherein the difference between the particular numerical value and zero defines an integer representing an offset location for the second discrete parallel data and wherein the second signal is produced when the subtracted address becomes zero.

18. The method of claim 13 wherein the step of controlling the second discrete parallel data includes providing a shift register responsive to the second discrete parallel data for shifting such second discrete parallel data and a plurality of "n" multiplexers and wherein the multiplexers provide offsets in time form one another by time increments corresponding to the time between successive clock signals at the first particular clock frequency and wherein the first signal shifts out the second discrete parallel data to one of the plurality of multiplexers and wherein the second signal controls the selection of the multiplexer which receives the second discrete parallel data.

19. Apparatus for synchronizing data, at a selected address defining a particular position on a screen in a video display, between systems having different clock frequencies where one of the systems includes a first device for receiving first parallel data and for producing at a first clock frequency first serial data synchronized at the selected address, including first means for producing second parallel data at a second clock frequency constituting a submultiple, defined by the integer "n", of the first clock frequency, the second parallel data being produced in groups of the integer "n", second means responsive to the selected address and to the integer "n" for arithmetically subtracting the integer "n" from the address upon the successive occurrences of the clock signals at the second frequency to produce successive numerical values, third means coupled to the second means and responsive to the successive numerical values to produce a first signal when the successive numerical values reach a particular numerical value and to produce a second signal representative of an offset position, less than "n", for the second parallel data relative to the first serial data, and fourth means coupled to the first and third means and responsive to the second parallel data produced in groups of "n" and responsive to the first and second signals for initiating the production of the second parallel data by the first means in accordance with the first signal and for offsetting such second parallel data in accordance with the second signal to synchronize the second parallel data with the first serial data at the particular address.

20. The apparatus of claim 19 wherein the first device includes a digital-to-analog converter and a random access memory and wherein the first parallel data represents color information and wherein the random access memory and the digital-to-analog converter form a color palette to control the color information at individual color positions and wherein the first serial data represents the controlled color information at the first clock frequency.

21. The apparatus of claim 20 wherein the first means includes a random access memory for storing information representing a cursor to be superimposed on the color information.

22. The apparatus of claim 19 wherein the second means includes a down counter for subtracting the integer "n" from the address upon the successive occurrence of the clock signals at the second frequency to produce the successively decreasing numerical values and wherein the third means produces the first signal when the address indicates the particular numerical value and wherein the second signal represents the difference between the particular numerical value and zero.

23. The apparatus of claim 22 wherein the difference between the particular numerical value and zero is defined by an integer representing an offset location for the second parallel data.

24. The apparatus of claim 19 wherein the fourth means includes a shift register to the second parallel data and a plurality of "n" multiplexers and wherein each multiplexer provides an offset in time from the other multiplexers by time increments corresponding to the time between successive clock signals at the first particular clock frequency and wherein the shift register shifts out the second parallel data to one of the plurality of multiplexers upon the production of the first signal and wherein the second signal controls the selection of the multiplexer which receives the second parallel data.

* * * * *